United States Patent [19]

Peterson, Jr.

[11] 4,062,500

[45] Dec. 13, 1977

[54] COMMINUTION DEVICE

[75] Inventor: Russell I. Peterson, Jr., Bay City, Mich.

[73] Assignee: Conair, Inc., Franklin, Pa.

[21] Appl. No.: 667,301

[22] Filed: Mar. 16, 1976

[51] Int. Cl.[2] ..... B02C 18/16

[52] U.S. Cl. ..... 241/285 R

[58] Field of Search ..... 241/73, 222, 224, 285 R, 241/285 A

[56] References Cited

U.S. PATENT DOCUMENTS

| | | | |
|---|---|---|---|
| 2,542,778 | 2/1951 | McIntyre | 241/285 A X |
| 2,784,914 | 3/1957 | Powers | 241/285 R X |
| 2,965,318 | 12/1960 | Jordan | 241/285 R X |
| 3,144,213 | 8/1964 | Hedlund | 241/285 R X |
| 3,211,388 | 10/1965 | Gartner | 241/285 R X |
| 3,419,223 | 12/1968 | Morin | 241/73 |
| 3,680,797 | 8/1972 | Covey | 241/73 |
| 3,897,016 | 7/1975 | Shah | 241/224 X |

*Primary Examiner*—Roy Lake
*Assistant Examiner*—Howard N. Goldberg

[57] ABSTRACT

A Comminution Device having a comminution structure comprising relatively movable portions with such portions being accoustically isolated from the remaining structure of such device other than the power input shaft to the comminution structure.

7 Claims, 3 Drawing Figures

FIG. 1
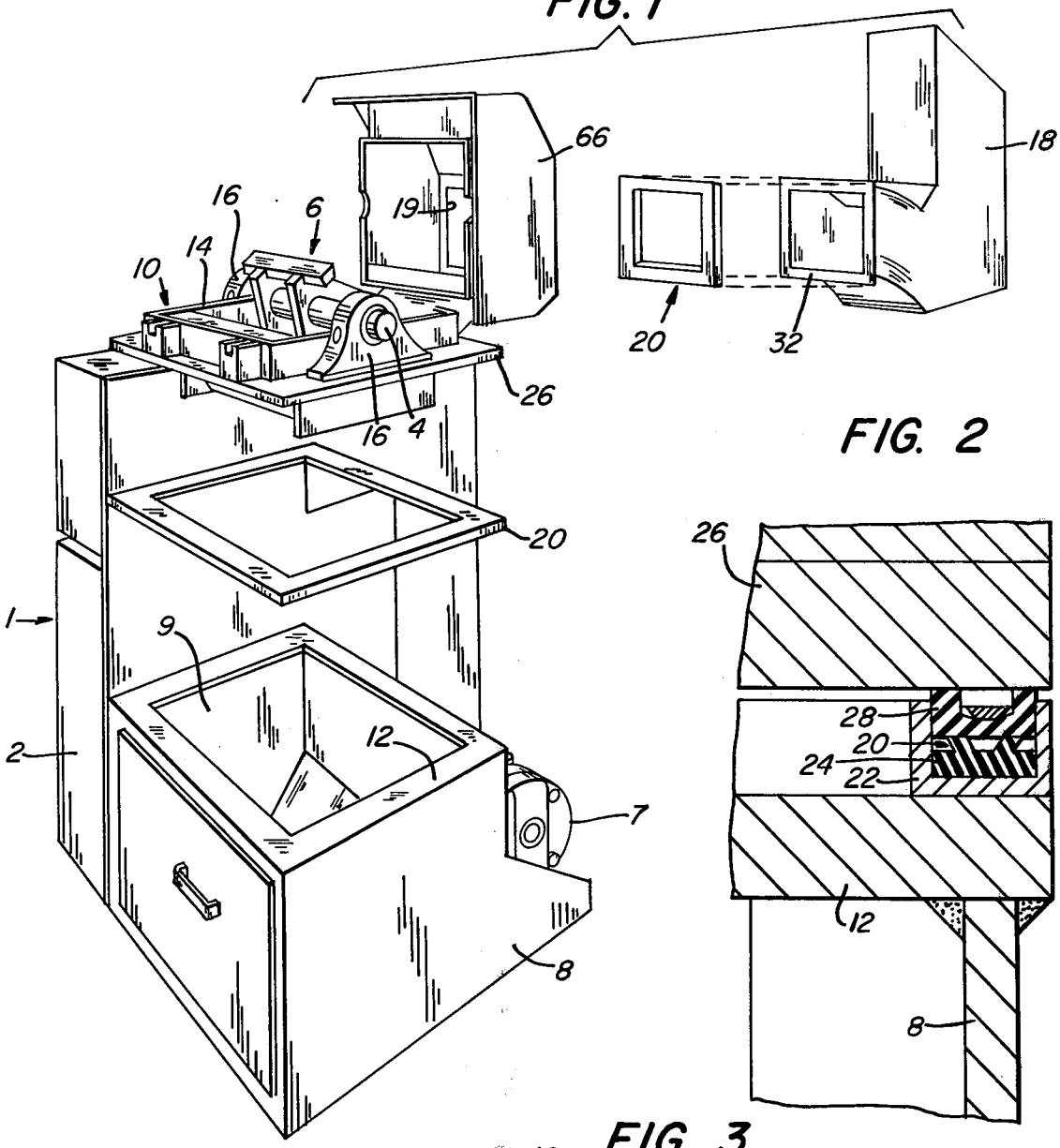
FIG. 2
FIG. 3
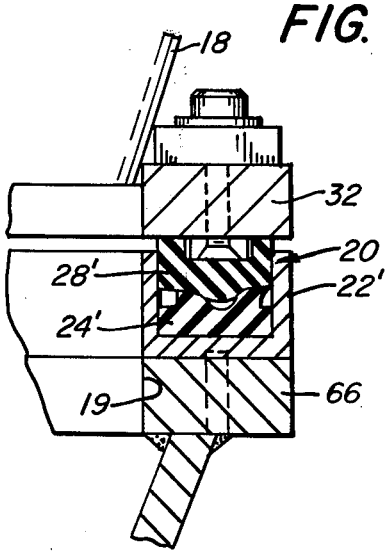

COMMINUTION DEVICE

Cross-Reference to copending Related Applications Ser. No. 668,062 (now Ser. No. 799,457, filed May 23, 1977) and Ser. No. 667,400 originally filed concurrently herewith each entitled Communication Device and incorporated herein for purposes of comprising the complete disclosure of this application.

Communication devices are used in various industries with one particularly well known prior use being in the plastics industry in which such devices are commonly referred to as granulators or plastics granulators.

Plastics granulators are commonly used to fragmentize sections or chunks of plastic material resulting from various plastic forming operations. Such sections or chunks are of a wide variety of thicknesses, form and material which vary in hardness so that during their fragmentation a number of impact forces are transmitted from the comminution structure to the housing which supports the comminution structure. This transmission of forces to the housing plus the noise resulting from the piercing and fragmatizing of the plastic sections creates a level of noise which is undesirable in accordance with present day accoustic standards for machines.

Accordingly one object of this invention is to provide a new and improved comminution device having a comminution structure substantially completely vibrationally isolated from the supporting and enclosing housing.

A more specific object of this invention is to provide a new and improved plastics granulator having cooperable rotating and stationary knife assemblies which knife assemblies are vibrationally isolated from the encompassing housing other than the power input shaft.

These and other objects and advantages of the present invention will become more readily apparent upon a consideration of the following description and drawings of a preferred embodiment of the invention in which:

FIG. 1 is a perspective view of a granulator constructed in accordance with the priciples of this invention with portions thereof being displaced relative to each other to more clearly illustrate the structure thereof;

FIG. 2 is an enlarged cross-sectional view of a section of a comminution structure and the supporting structure of the granulator as shown in FIG. 1 illustrating the structure for reducing the transfer of vibrations from the comminution structure and such supporting structure, and FIG. 3 is an enlarged cross-sectional view of a section of the comminution structure and the portion of the encompassing housing extending thereabove illustrating the structure for reducing the transfer of vibrations from the comminution structure and such housing.

Referring to FIG. 1 a plastics granulator generally comprises a formed housing 1 having a vertically extending portion 2 at one side thereof which housing portion 2 encloses a suitable flywheel, not shown, with the central shaft of such flywheel being coupled to a power input shaft 4 of a comminution structure comprising a rotor 6, and a stationary assembly 10. The housing 1 has a lower base 8 which defines a material receiving compartment 9 therein. A suitable motor 7 is suitably supported by base 8 to drive the flywheel as is well known in the art. Base 8 has an upper inwardly extending peripheral flange 12 to which the stationary assembly 10 is suitably rigidly secured. Assembly 10 includes suitable stationary or bed knives 14 (only one of which is shown) and suitable bearing means 16 for rotatably supporting the rotor 6 such that the rotor knives 15 carried by the rotor 6 are cooperable with the bed knives 14 to obtain fragmentation of plastic pieces or sections.

With stationary assembly 10 secured to flange 12 the lower portion of the assembly 10 and the rotor 6 are located within the compartment 9. A cover 66 is pivotably connected to the rearward portion of the stationary assembly 10 so that when closed and secured to the stationary assembly 10 the upper portion of the assembly 10 and the rotor 6 are enclosed within the cover 66. A formed hollow material receiving compartment 18 is rigidly secured to the upper portion of cover 66 to provide for feeding material through compartment 18 through an upper, when cover 66 is closed, opening 19 in cover 66 to the comminution structure. Inasmuch as the arrangement and structure of the granular as heretofore described is not a part of this invention and are more fully shown and described in the indentified cross-referenced applications further description thereof is not necessary.

To achieve the purpose of this invention the comminution assembly is isolated from the remaining portions of the granulator by means of suitable supports 20 with one such support 20 being located on the flange 12 between the base 8 and the stationary assembly 10 (see FIG. 2) and the other of such supports 20 being located between the cover 66 and the upper compartment 18 (see FIG. 3).

As illustrated in detail in FIG. 2 a suitable channel 22 is suitably rigidly secured to the flange 12 to provide an upwardly continuously open channelway around the entire periphery of the upper end of the base 8. A lower pad 24 is located within such channelway in engagement with the upper surface of the bight portion thereof and which pad 24 extends laterally between the upwardly extending arms of channel 22 and continuously throughout the peripheral channelway. The stationary cutter assembly 10 includes a peripheral flange 26 which extends outwardly of the entire periphery thereof with a portion thereof overlying the channel 22. An upper pad 28 is suitable affixed to the undersurface of flange 26 and extends downwardly therefrom in registery with the pad 24 throughout the extent of pad 24. Pad 28 extends continuously through the channelway of channel 22 and laterally between the arms of channel 22; however, pads 24 and 28 are of a combined thickness so that when under the weight of the structure supported thereby the upper surfaces of the arms of channel 22 are spaced from the underside of flange 26.

Pads 24 and 28 are formed from a suitable resilient elastomeric material to minimize the transmission of vibration from the comminution structure to the base 8 whereby the housing 2 is isolated from such vibration and consequently prevent audible vibration of the housing 2. The pads 24 and 28 are selected with relation to the loading applied thereto and for the purposes of this invention a pad sold by Gilmore Industries Inc. of Cleveland, Ohio which is sold under the trademark ISOMODE has proven to be satisfactory. Such ISOMODE pads feature a crossribbed construction which provides effective isolation of all basic modes of vibration and are molded from Dupont Neoprene with a 45 durometer pad being recommended for nominal loading of 50 psi and a 65 durometer pad being recommended for 150 psi loading. Unloaded the pads are 5/16 inches thick and under the recommended loading the pads are compressed 1/16 of an inch. Such ISOMODE pads are secured to the structural members in accordance with the recommendations of Gilmore Industries.

By providing such isolating pads 24 and 28 as described the vibration resulting from the impacting of the knives 15 of the rotor 6 on the plastic sections being fragmatized and the resulting impact force on the stationary assembly 10 are isolated from the base 8 and consequently the base 8 will not vibrate to produce an annoying audible noise.

The upper portion of cover 16 is provided with an upwardly open channel 22' similar to channel 22 which is suitably rigidly secured to the cover 66 to extend around the opening 19 and provide a continuously open channelway for receiving a continuous pad 24' identical to pad 24 continuously around the entire upper periphery of the cover 66. The lowermost portion, when closed, of compartment 18 is provided with an outwardly extending continuous peripheral flange 32 at its lower end (when closed) which has a pad 28' depending thereupon in registry with the pad 24'. The arms of channel 22' are spaced from the lower surface of the flange 32 when under the weight of the compartment 18. With the structure described the comminution structure is isolated from the housing 2 and the compartment 18 other than the shaft 4 so that vibration of the housing 2 and the compartment 18 is minimized and annoying audible vibration of housing 2 and compartment 18 is eliminated. Since the shaft 4 is connected to a flywheel drive motor 7 by flexible belting the connection of the shaft 4 to the flywheel will not produce any substantial audible vibration.

Although as described the pads 24 and 28 are identical to pads 24' and 28', if desired, the pads 24' and 28' may be smaller in size since the weight of compartment 18 in the comminution assembly is less than the weight of the comminution assembly upon the base 8. Further the means for securing the cutter assembly 10 to the base 8 is vibrationally isolated in any suitable manner. The stationary assembly 10 is rigidly secured to base 8 in any suitable manner which normally comprises bolt and nut assemblies extending through aligned clearance openings. Such bolt and nut assemblies are provided with suitable means to minimize the transfer of vibrations therethrough such as resilient washers. If desired or convenient such bolt and nut assemblies can extend through aligned clearance openings in the pads 24 and 28. Similarly suitable bolt and nut assemblies can be utilized to rigidly secure the compartment 18 to the cover 16 and again, if desired, such bolt and nut assemblies can extend through clearance openings in the pads 24' and 28'.

Although I have described a preferred embodiment of my invention in accordance with the Patent Statutes and indicated some modifications that may be made thereto, I am aware that other modifications may be made without departing from the scope of my invention by one skilled in the art and accordingly the invention is to be interpreted in accordance with the scope of the appended claims.

What is claimed is:

1. A comminution device comprising: a housing; a comminution structure having a stationary portion and a rotating cutter supported by said stationary portion inwardly of the outer periphery of said stationary portion; said stationary portion being supported by said housing to extend horizontally with one side of said outer periphery continuously overlying a continuous support portion of said housing; continuous vibration isolating means carried by said one side of said outer periphery, independent continuous vibration isolating means carried by said support portion; and said isolating means being in continuous overlying relationship and in engagement with each other.

2. A comminution device as set forth in claim 1 in which said cutter portion has its upper extent enclosed by cover means carried by said stationary portion, material inlet means having an elongated passageway extending therethrough, said cover means having an upwardly extending opening therein in registry with one end of said passageway, said inlet means and said cover having opposed portions located outwardly of said opening and encompassing said opening, continuous vibration isolating means carried by said opposed portion of said inlet means, independent continuous vibration isolating means carried by said opposed portion of said cover means, and said isolating means being in continuous overlying relationship and in engagement with each other.

3. A comminution device as set forth in claim 1 in which said isolating means carried by said one side of said outer periphery and said independent isolating means carried by said support portion comprise a pair of formed pads.

4. A comminution device as set forth in claim 2 in which said isolating means carried by said opposed portion of said inlet means and said independent isolating means carried by said opposed portion of said cover means comprise a pair of formed pads.

5. A comminution device as set forth in claim 4 in which said isolating means carried by said one side of said outer periphery and said independent isolating means carried by said support portion comprise a pair of formed pads.

6. A comminution device as set forth in claim 5 wherein each of said pairs of formed pads are of the same cross sectional configuration.

7. A comminution device as set forth in claim 6 wherein each of said pairs of formed pads are of identical cross section.

* * * * *